United States Patent [19]

Kascak

[11] Patent Number: 4,822,027

[45] Date of Patent: Apr. 18, 1989

[54] THERAPEUTIC HAND AND ARM EXERCISE DEVICE

[76] Inventor: Thomas R. Kascak, 50 Parkway Dr., Trumbull, Conn. 06611

[21] Appl. No.: 244,322

[22] Filed: Sep. 15, 1988

[51] Int. Cl.[4] ..... A63B 5/00; A63B 21/22

[52] U.S. Cl. ..... 272/67; 272/132; 272/142; 272/DIG. 4; 128/26

[58] Field of Search ..... 272/67, 68, 134, 132, 272/127, 146, 96, 901, 93, 142; 128/26; 84/465, 467, 468

[56] References Cited

U.S. PATENT DOCUMENTS

| | | | |
|---|---|---|---|
| 1,531,670 | 3/1925 | levy | 272/96 |
| 2,760,774 | 8/1956 | Perez | 272/96 |
| 2,819,081 | 1/1958 | Touraine | 272/127 |
| 2,832,334 | 4/1958 | Whitelaw | 272/132 |

*Primary Examiner*—Richard J. Apley
*Assistant Examiner*—S. R. Crow
*Attorney, Agent, or Firm*—Arthur T. Fattibene

[57] ABSTRACT

A baseboard having an extension attached to one end for restraining a patient's forearm and having a hand board pivotally attached to the other end providing adjustable force and movement in a plane parallel to the plane of the baseboard. The hand board has a handle adjustably attached perpendicular thereto for positioning against the patient's hand. An adjustable force, in both direction and magnitude, can be easily applied to the patient's injured arm or hand with elastic means. The force is adjustable so as to be applied in a direction and magnitude that will optimize the rehabilitation of the patient's damaged tissue caused by a previous injury or surgery.

12 Claims, 3 Drawing Sheets

THERAPEUTIC HAND AND ARM EXERCISE DEVICE

FIELD OF THE INVENTION

This invention relates generally to a therapeutic hand, wrist, and forearm exercise device and more particularly to a therapeutic device for providing prolonged low-intensity stretching.

BACKGROUND OF THE INVENTION

After an injury it is often necessary for the injured individual to see a physician and/or therapist to obtain as full a recovery as possible from the injury. This can be a time consuming and frustrating period for both the treating individual and the patient.

If the injury involves the connective tissues in the hand and arm, these tissues must be mobilized to obtain the full extent of motion that is physically indicated by the nature of the injury. The connective tissues are made of various densities and spatial arrangements of collagen fibers embedded in a protein-polysaccharide matrix. Collagen is a fibrous protein that has a very high tensile strength, and is contained in many connective tissue structures such as tendons, ligaments, and joint capsules among others. The range of motion in most body joints is primarily limited by these connective tissue structures. Muscles are generally regarded as not limiting the range of motion of a joint when the muscle is relaxed. However, since connective tissue is part of the muscle unit structure, it is possible during the recovery process for muscle shortening to occur or "guarding/spasm" to predominate. Such muscle restriction needs to be rectified in conjunction with other connective tissue limitations.

In order to extend the range of motion of the joint, the connective tissues must be stretched. In order to obtain lasting results, the connective tissues must be stretched to a point of plastic deformation. The stretching of connective tissues, either elastic or plastic, is dependent on several factors including the amount and duration of the applied force. The force applied must not be large enough to cause physical tearing of the connective tissues. Physically tearing the connective tissues results in injury, bleeding, pain, instability, and worsening scar formation rather than improving the condition of the patient.

Low force, long duration stretching of the injury results in lasting improvement in the range of motion of the joint. The application of heat during stretching and subsequent cooling has been shown to additionally help increase the plastic deformation of the connective tissue and therefore aids in permanently improving the range of motion of the joint. Typically, this involves a therapist carefully working the joint over an extended period. This method is time consuming and inefficient for the therapist. One-on-one treatment such as this stretching is costly to the patient in treatment time, travel, and cost. Any missed appointments are reflected in reduced benefits and thus prolonged recovery. Additionally, a therapist does not have unlimited time to spend on one patient's stretch several times per day. Therefore, there is a need to relieve the therapist from this tedious task.

While there are numerous exercise devices none can adequately satisfy all of the needs of the therapist. For example the devise disclosed in U.S. Pat. No. 1,879,401 entitled "Exercising Device" issued to L. P. Monaco on Sept. 27, 1932. Therein disclosed is a device for the exercising of paralyzed limbs. The device comprises a floating table on rollers having a window therein. The window permits the patient to use his or her fingers for other purposes such as writing. The rollers permit the patient to exercise his or her upper arm. Pegs are also included on the floating table permitting the patient to exercise his or her fingers by moving them up and over the stationary pegs. This device, while performing its intended function, does not provide a continuous force for the stretching of damaged connective tissue.

Another device disclosed in U.S. Pat. No. 2,819,081 entitled "Exercisers" issued to J. Touraine on Jan. 7, 1958 provides beneficial resistance exercise treatment, but does not provide advantageous stretching force. Yet another device is disclosed in U.S. Pat. No. 2,832,334 entitled "Therapeutic Device For Use In Manipulative Treatment Of Joints Of The Human Body" issued to S. H. Whitelaw on Apr. 29, 1958. The Whitelaw device is a somewhat complex mechanical device that provides resistance force through mechanical gearing and friction members. This device does not provide a constant stretching force helpful in achieving beneficial plastic deformation of damaged connective tissue. A still more complex device is disclosed in U.S. Pat. No. 4,641,832 entitled "Wrist/Ankle Exercising Apparatus" issued to E. M. Mattox on Feb. 10, 1987. The devise disclosed in Mattox provides resistance force combined with a measuring mechanism for determining the external forces exerted by the user. Again, this device does not provide a constant stretching force helpful in achieving beneficial plastic deformation of damaged connective tissues.

While all of the above discussed devices provide beneficial exercising treatment none can adequately fulfill the needs of the therapist treating range of motion limiting injuries. Therefore, there is a need for an easy to use exercising device that can be used by therapists for the treatment of injuries limiting range of motion.

SUMMARY OF THE INVENTION

The present invention comprises a baseboard with a restraining means attached thereto for securely holding a patient's forearm. A hand board is pivotally attached to the baseboard providing movement in a plane parallel to the plane of the baseboard. A handle extends from the hand board and is adjustably attached thereto. An adjustable elastic means is attached to the hand board and the baseboard for providing an adjustable force there between. The patient's forearm is secured to the baseboard as the handle is grasped or positioned on the desired hand surface. A controllable amount of force can then be applied to the involved joint over an extended period of time to stretch the injured tissue. All of the four primary wrist motions, flexion, extension, radial deviation, ulnar deviation, can be addressed separately as the needs of the patient demand, by altering forearm position, handle placement against the hand surfaces, and direction of elastic force. In one embodiment, the restraining means is provided by a plurality of slidable cam assemblies capable of securing the patient's forearm while providing access to the forearm for the purpose of applying thermal treatments, thereby providing the best possible recovery of the injured hand or arm.

Therefore, it is an objective of the present invention to provide a device that will augment the therapist's ability to treat patients.

It is another objective of the present invention to provide a device that is controlled by the patient with the therapist's guidance.

It is yet another objective of the present invention to provide a device that is safe, easy to use, and not intimidating to the patient.

It is an advantage of the present invention that it is relatively small in size and weight.

It is another advantage of the present invention that it is not electronic or computerized.

It is a feature of the present invention that it is portable.

It is another feature of the present invention that it is inexpensive to build and of simple construction.

DETAILED DESCRIPTION OF THE BEST MODE

Figure 1:
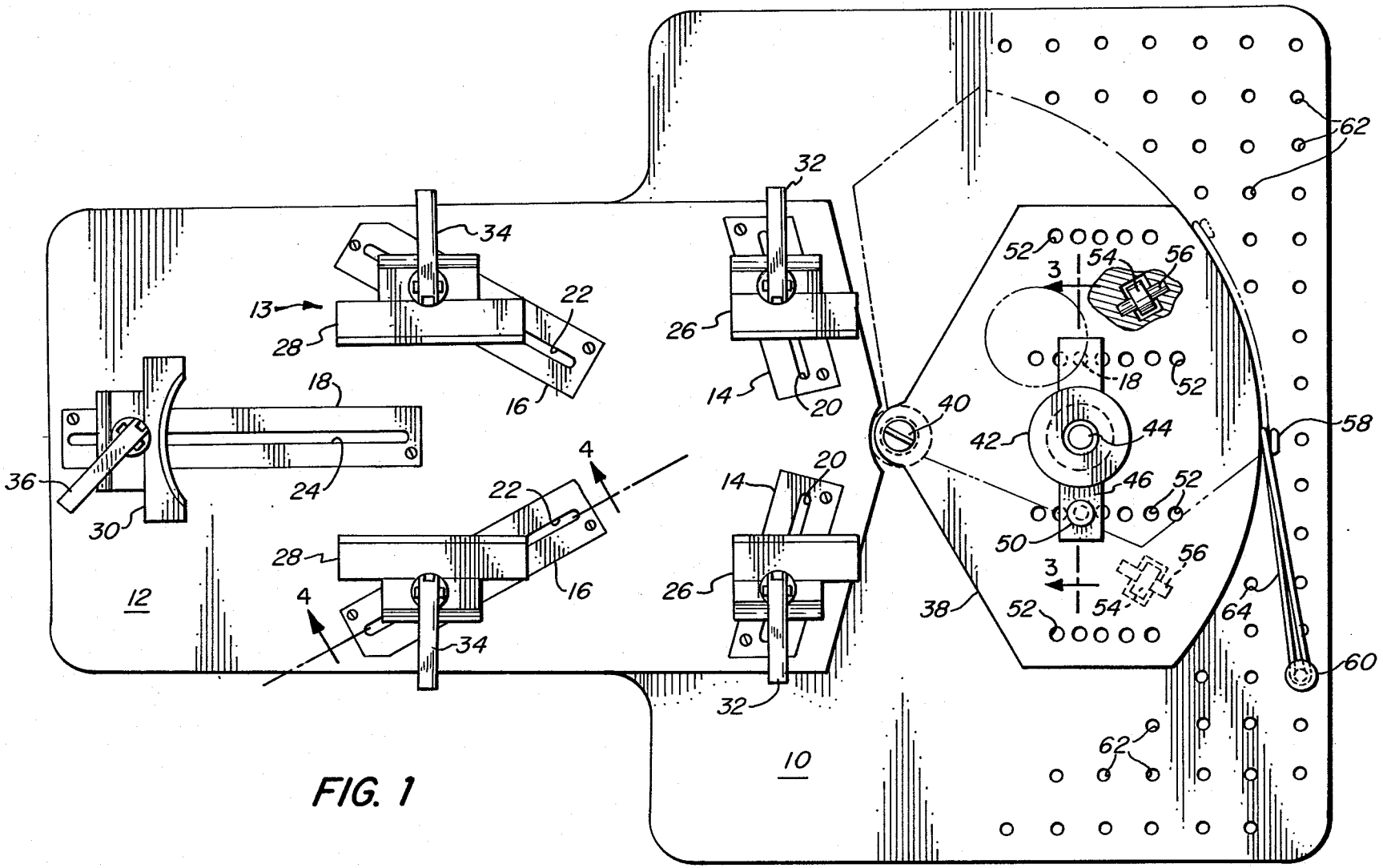
FIG. 1 is a plan view with a partial section of the present invention.

FIG. 1 illustrates the present invention. Attached to baseboard 10 is an extension 12. Extension 12 has several sliding cam assemblies 13 attached thereto. The blocks 26, 28, and 30 attached to the sliding cam assemblies 13 are used to confine the patient's forearm to the extension 12. Blocks 26 and 28 are angled in consideration of the normal forearm shape, wide near the elbow and narrow near the wrist. The cam assemblies 13 slide within plates 14, 16, and 18. The two front plates 14 are slightly angled helping the front blocks 26 to obtain a secure grasp on the patient's forearm when inserted therebetween. The two middle plates 16 are angled even more so that the securing force applied by middle blocks 28 to the patient's forearm can be accurately and easily controlled. Finally, the rear plate 18 is positioned parallel to the patient's forearm to provide a firm support for the patient's elbow with rear block 30. Each of the blocks 26, 28, and 30 can be secured in any position along the slots 20, 22, and 24 respectfully. Thus the device accomodates a wide variety of patient forearm sizes. Handles 32, 34, and 36 are used to secure the sliding cam assemblies 13. The use of the sliding cam assemblies 13 is advantages in that the forearm is exposed permitting access for other treatment such as the application of hot and cold compresses.

Pivotally attached to the baseboard 10 at the end of the extension 12 is a hand board 38. Pivot 40 permits the hand board 38 to pivot in a plane parallel to the plane of baseboad 10. Adjustably mounted on the hand board 38 is a handle 42. Handle 42 is attached to a base 46 by shaft 44. The handle 42 can be securely attached to base 46 or can be fitted to permit free rotation. The base 46 has a fixed pin 48 and a free pin 50 attached at either end thereof. The fixed pin 48 is securely attached to the base 46 and can not be easily detached therefrom. The free pin 50 can easily be detached from base 46. This fixed-free pin combination makes adjustments quicker and easier. Either of the fixed or free pins 48 and 50 can be fitted in handle holes 52. A variety of adjustments can then be made by combining both the distance from and the angle to the pivot 40 for providing the most beneficial positioning for optimal treatment to the patient. Beneath the hand board 38 are rollers 54. Rollers 54 are attached to hand board 38 by roller pins 56. The rollers 54 are positioned so that their axis of rotation is on a radial extending from pivot 40. This permits the hand board 38 to glide without binding on baseboard 10.

At the end of the hand board opposite pivot 40 is a knob 58. A band of elastic 64 is looped over knob 58 at one end. The other end of elastic 64 is looped over baseboard pin 60. Baseboard pin 60 is placed in any of the plurality of holes 62 in the baseboard 10. By judicial placement of the pin 60 the force supplied to the injured hand or arm can be optimized for the most beneficial treatment. The magnitude of force supplied to the injured hand or arm can be precisely controlled by the placement of bands of elastic 64 of varying guage and length around pin 60 and knob 58. The magnitude of the force can be additionally controlled by placement of the pin 60 in a hole 62 further away or closer to knob 58.

Figure 2:
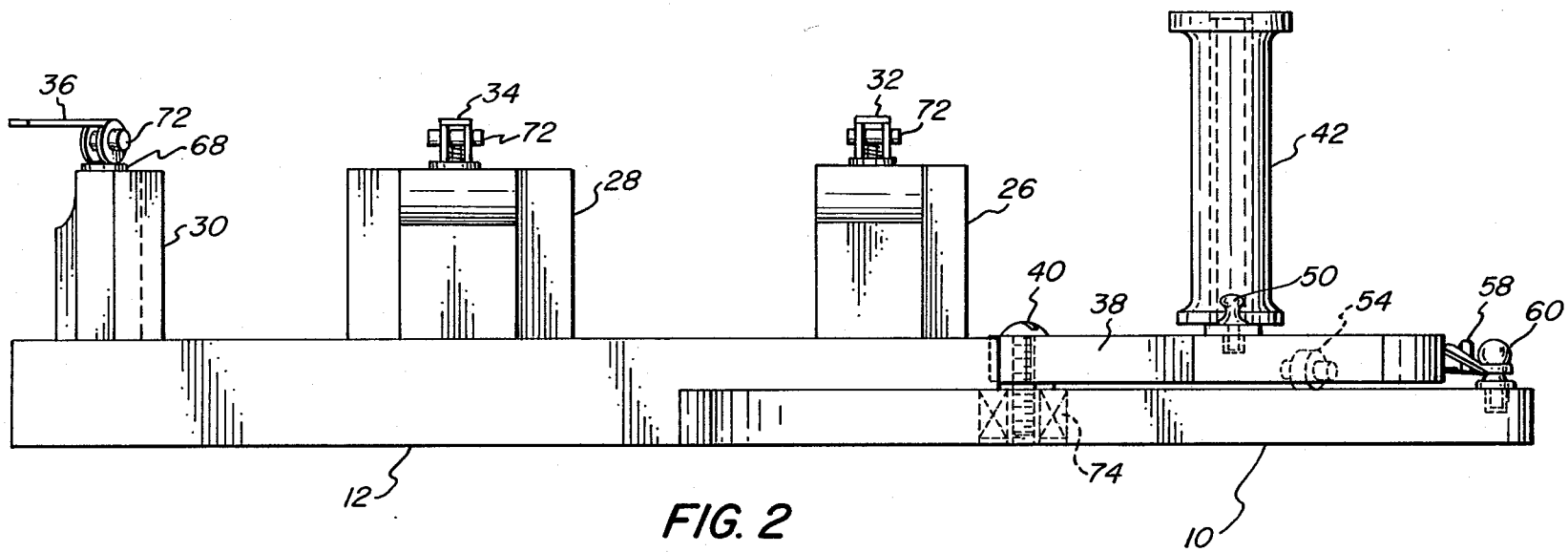
FIG. 2 is a front elevational view of the present invention.

FIG. 2 is a front elevational view of the invention as illustrated in FIG. 1. In FIG. 2 the rollers 54 can more easily be seen. Rollers 54 are shown as wheels rotating about an axial, but can take the form of any device that will permit smooth easy movement between the hand board 38 and the top surface of baseboard 10. Also illustrated in FIG. 2 is bearing 74 which helps provide smooth movement of the hand board 38.

Figure 3:
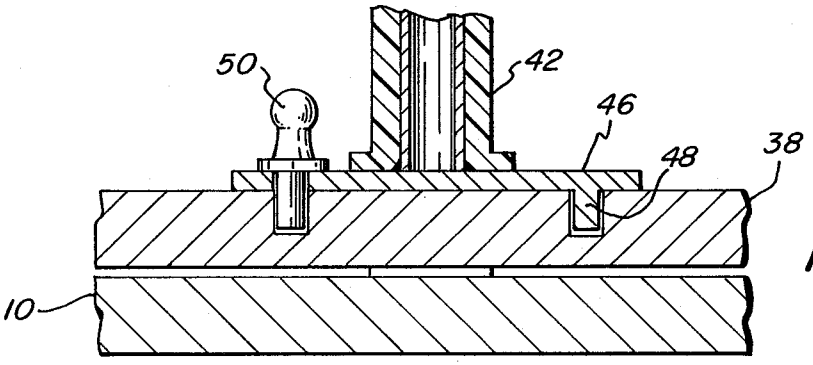
FIG. 3 is a cross sectional view taken along line 3—3 in FIG. 1.

In FIG. 3 the base of handle 42 can more easily be seen. The fixed pin 48 of base 46 can clearly be seen in the hole within hand board 38. The free pin 50 is also clearly shown extending through base 46 into hand board 38. The free pin 50 and fixed pin 48 make the placement of the handle 42 easier. In adjusting handle 42 in a position that will provide the most beneficial positioning, either the handle 42 can be lifted and the fixed pin 48 can be inserted into another hole or only the free pin 50 need be removed permitting the handle 42 to pivot about the fixed pin 48. This makes possible large or small adjustments that will provide an optimal therapeutic location for the handle 42.

Figure 4:
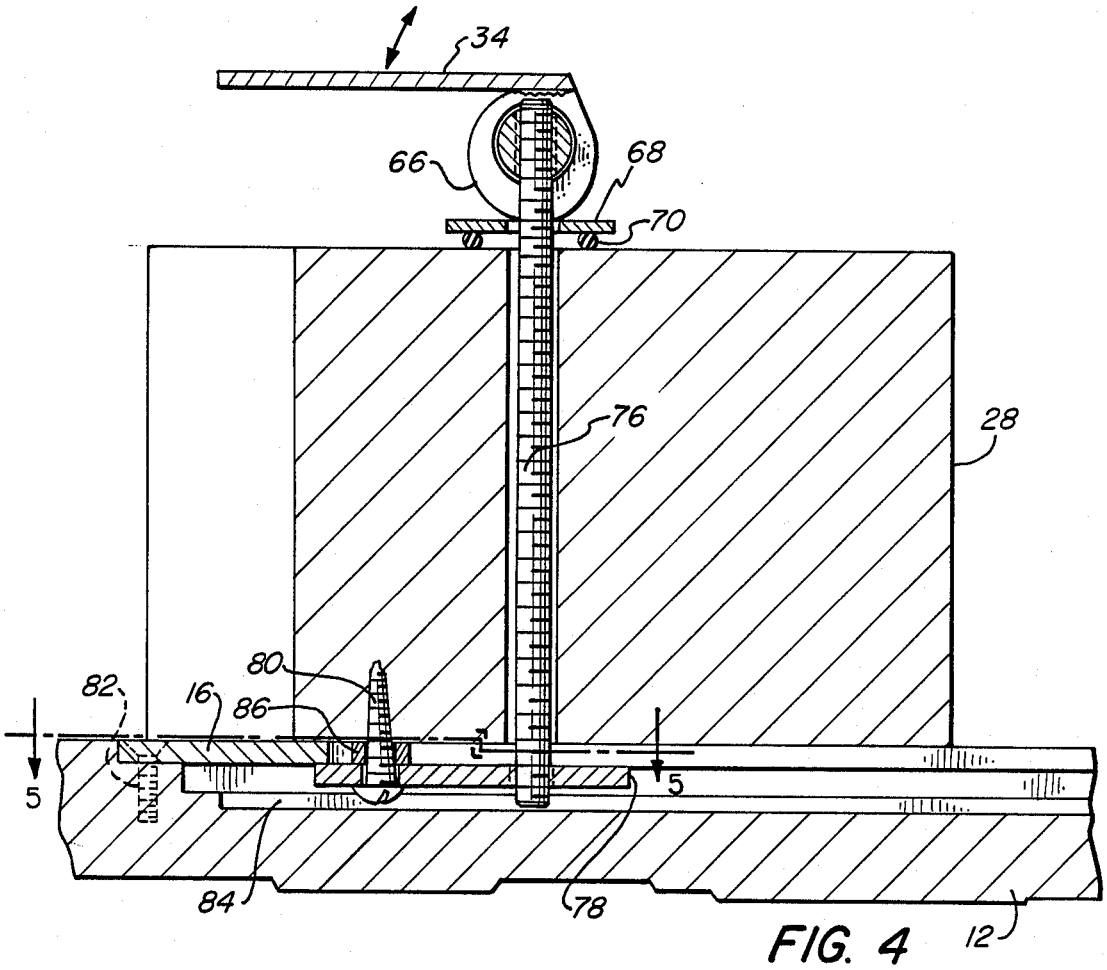
FIG. 4 is a cross sectional view taken along line 4—4 in FIG. 1.

FIG. 4 more clearly illustrates one of the arm restraining block assemblies. In FIG. 4 the operation of the assembly can more fully be understood. Attached to extension 12 is plate 16 by screw 82. Plate 16 has a slot 22, shown in FIGS. 1 and 5, therein. Friction plate 78 is positioned in a recess 84 in extension 12. Friction plate 78 is prevented from being removed from the recess 84 by plate 16. One end of friction plate 78 is attached to block 28 by screw 80. To prevent the one end of the friction plate 78 from contacting plate 16 a spacer 86 is placed between the block 20 and the friction plate 78. To permit free movement the spacer 86 should be at least as thick as plate 16. The other end of friction plate 78 is threaded to lever screw 76. Lever screw 76 extends up through block 28 and is threaded into cam 66. A washer 68 and gasket 70 separate the cam 66 from the block 28. The washer 68 provides a smooth hard surface for cam 66 to slide over. Lever 34 is attached to cam 66 to provide leverage in rotating cam 66. Cam 66 can be rotated by lever 34 in two directions to provide two different adjustments, a set-up adjustment and a use adjustment. The set-up adjustment is performed initially to assure that the travel of the cam 66 is adequate to fully engage the friction plate 78 against plate 16 to prevent movement of block 28. This is done by rotating the handle 34 about the longitudinal axis of lever screw 76 so that cam 66 is moved up and down axially thereon. Once the set-up adjustment is performed the use adjustment is made by sliding block 28 into position and then rotating lever 34 perpendicular to the longitudinal axis of lever screw 76. This causes cam 66 to rotate raising lever screw 76 up forcing friction plate 78 into contact with plate 16 preventing the movement of block 28. The other blocks 26 and 30 operate in the same way. The patient's arm can then be securely positioned therebetween while still providing access to the arm for simultaneous heat or cold treatment if desired.

Figure 5:
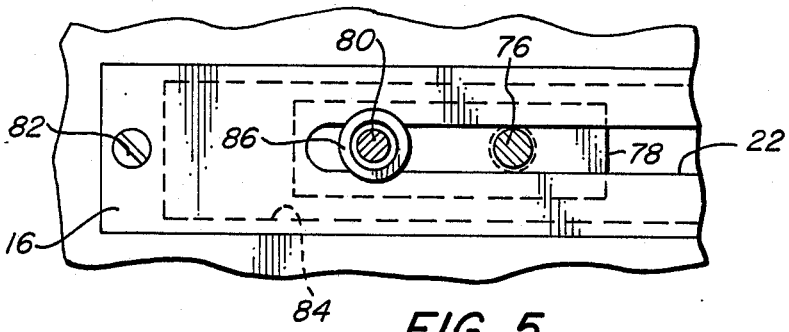
FIG. 5 is a cross sectional view taken along line 5—5 in FIG. 4.

In FIG. 5 the position of the friction plate 78 can be more easily seen. Friction plate 78 is placed in recess 84 and then covered by plate 16.

Referring to FIG. 1 the operation of the device can easily be understood. The forearm of the injured arm or hand is placed between blocks 26 and 28 with the patient's wrist joint axis positioned over pivot 40. Blocks 26, 28, and 30 are then slid into position along slots 20, 22, and 24 respectfully. Slots 20 and 22 are angled to provide easier and more accurate adjustments against the length of the forearm. Block 30 is slid into position against the patient's elbow to achieve secure stabilization in two directions. After the blocks 26, 28, and 30 are adjusted, the handle can then be moved on hand board 38 to a suitable location. Baseboard pin 60 can then be positioned in an appropriate hole 62 to provide the proper magnitude of force for the particular injury. Force can be altered by varying the guage or length of one elastic 64 or more than one can be added or removed to provide the proper force to optimize the rehabilitation of the injured tissue. The elastic 64 can comprise a rubber band, or any elastic material that provides a yielding resistive force. In some applications this will involve little movement and only a stretching force will be supplied for an extended time. In other applications the patient can provide active movement against the resistive force of the elastic in order to provide dynamic exercise and thus strengthening of the injured tissue.

In those cases when muscle shortening, spasms, or guarding is the predominant restriction, techniques based on the neurophysiological basis of patient treatment can be employed with this device. Specifically, a technique directed toward relaxation or inhibition of the muscle is possible. This device is suited for the "hold-relax" technique taught with proprioceptive neuromuscular facilitation. By voluntarily contracting the muscle being stretched in an isometric effort, the immediate post-contraction period leads to reflex inhibition of the muscle just finished contracting. This allows the elastic force to provide an effective stretch to the muscle and thus increase its length. The elastic force can be supplemented by an active effort of the patient using the antagonist to the muscle group being stretched. Isometric muscle contraction can be provided by using a block to inhibit motion of the hand during the effort. The block is easily provided by the patients other hand preventing movement of handboard 38 or by fixing the hand board 38 to the baseboard 10 or by use of a stop peg inserted in a hole formed in the baseboard 10. The option also exists for isotonic muscle contraction against the elastic force should that be preferred to isometric efforts. The electrically silent period from Ia sensory fibers occurs when agonist extrafusal fibers contract. The muscle spindle goes slack leading to the situation where sensory fibers will not fire and thus the agonist will not be facilitated. During this phase, the muscle itself can be stretched more than when the muscle spindle is biased. After a short period of time, biasing will occur as tonic gamma fibers fire and take up the slack such that the spindle will again be taught. Voluntarily firing the antagonist to the muscle group being stretched during the electrically silent period will further inhibit contraction of the agonist. This allows more effective stretching to occur.

While the invention has been described with respect to a particular embodiment it should be understood that variations and modifications may be made without departing from the spirit or scope of the invention.

What is claimed is:

1. A therapeutic range of motion hand, wrist, and forearm exercising device comprising:
   - a baseboard;
   - restraint means, attached to said baseboard, for securely holding a patient's forearm;
   - a hand board pivotally attached at one end to said baseboard providing movement in a plane parallel to said baseboard;
   - a handle adjustably attached to said hand board said pivoted end being disposed between said handle and said restraint means;
   - adjustment means, associated with said hand board, for adjusting the position of said handle in relation to said hand board; and
   - adjustable elastic means, attached between said baseboard and a second end of said hand board, for providing adjustable force between said baseboard and said hand board.

2. A therapeutic range of motion hand, wrist, and forearm exercising device as in claim 1 wherein said handle is substantially perpendicular to said hand board.

3. A therapeutic range of motion hand, wrist, and forearm exercising device as in claim 1 further comprising:
   - a pair of rollers attached to said hand board and resting on said baseboard.

4. A therapeutic range of motion hand, wrist, and forearm exercising device as in claim 1 wherein said adjustment means comprises:
   - said hand board having a plurality of holes therein; and
   - a pin attached to said handle and adapted to fit in each of said plurality of holes.

5. A therapeutic range of motion hand, wrist, and forearm exercising device as in claim 1 wherein said adjustment means comprises:
   - said hand board having a plurality of holes therein arranged in rows spaced a distance apart;
   - a handle base attached to said handle; and
   - a pair of pins associated with said handle base and spaced said distance apart.

6. A therapeutic range of motion hand, wrist, and forearm exercising device as in claim 5 wherein said pair of pins comprises:
   - a fixed pin irremovable from said handle base; and
   - a free pin removable from said handle base.

7. A therapeutic range of motion hand, wrist, and forearm exercising device as in claim 1 wherein said adjustable elastic means comprises:
   - said baseboard having a plurality of holes therein;
   - a pin adapted to fit within each of said plurality of holes;
   - a knob attached to said hand board; and an elastic loop attached between said said pin and said knob whereby a force is provided between said baseboard and said hand board.

8. A therapeutic range of motion hand, wrist, and forearm exercising device as in claim 7 wherein said elastic loop comprises:

a plurality of individual elastic loops each individually attachable to said pin and said knob whereby an adjustable degree of force can be selectively supplied between said baseboard and said hand board.

9. A therapeutic range of motion hand, wrist, and forearm exercising device as in claim 1 wherein said restraint means comprises:

a front restraint means for restraining the patient's arm approximately at the wrist;

a middle restraint means for restraining the patient's arm between the wrist and elbow; and a rear restraint means for restraining the patient's arm at the elbow.

10. A therapeutic range of motion hand, wrist, and forearm exercising device as in claim 9 wherein said front, middle, and rear restraint means each comprises:

a plate having a slot therein attached to said baseboard;

a friction plate positioned between said baseboard and said plate;

a block positioned on said plate;

a screw attaching one end of said friction plate to said block with said plate between said block and said friction plate;

a rod extending through said block and said plate securely attaching to said friction plate;

securing means, attached to said rod, for raising said rod drawing said friction plate into contact with said plate.

11. A therapeutic range of motion hand, wrist, and forearm exercising device as in claim 10 wherein said securing means further comprises:

a cam pivotally attached to the end of said rod opposite said friction plate;

a washer positioned around said rod and between said block and said cam; and a lever attached to said cam whereby moving said lever causes said cam to raise said shaft resulting in said friction plate contacting said plate securely holding said block in position.

12. A therapeutic range of motion hand, wrist, and forearm exercising device comprising:

a baseboard having a first plurality of holes therein;

an extension attached to one end of said baseboard;

a pair of front plates each of said front plates having a first slot therein attached to said extension and positioned adjacent each longitudinal edge of said extension so that the longitudinal extent of each said first slot is angled from the shortest transverse dimension of said extension;

a rear plate having a second slot therein attached to said extension so that the longitudinal dimension of said extension is parallel to the longitudinal extent of said second slot;

a pair of middle plates each of said middle plates having a third slot therein attached to said extension between said pair of front plates and said rear plate and positioned adjacent each longitudinal edge of said extension so that the longitudinal extent of each said third slot is angled from the shortest transverse dimension of said extension;

a plurality of friction plates, one of said plurality of friction plates positioned beneath each of said pair of front plates, rear plate, and pair of middle plates;

a plurality of blocks having a bore extending therethrough, one of said plurality of blocks positioned over each of said pair of front plates, rear plate, and pair of middle plates;

a plurality of rods, one of said plurality of rods extending through each bore of said plurality of blocks, one end of each said plurality of rods attaching to one of said plurality of friction plates;

a plurality of cams, one of said plurality of cams attached to the other end of each of said plurality of rods;

a plurality of levers, one lever attached to each of said plurality of cams;

a hand board having a second plurality of holes therein pivotally attached to said baseboard, said hand board attached so as to pivot in a plane parallel to said baseboard;

a handle;

a fixed pin attached to said handle adapted to fit separately within each one of said second plurality of holes;

a free pin detachably mounted on said handle adapted to fit separately within each one of said second plurality of holes;

a knob attached to said hand board;

a pin adapted to fit separately within each one of said first plurality of holes; and at least one elastic loop adapted to be attached between said knob and said pin whereby a force of predetermined magnitude and direction can be applied to an injury for optimizing the recovery of damaged connective tissue.

* * * * *